US006102388A

United States Patent [19]

Thornhill

[11] Patent Number: 6,102,388

[45] Date of Patent: Aug. 15, 2000

[54] ENVELOPE FEEDER

[75] Inventor: William Joseph Thornhill, Lexington, Ky.

[73] Assignee: Lexmark International, Inc., Lexington, Ky.

[21] Appl. No.: 09/129,616

[22] Filed: Aug. 5, 1998

[51] Int. Cl.[7] ..... B65H 3/06

[52] U.S. Cl. ..... 271/119; 271/125; 271/274; 271/10.11

[58] Field of Search ..... 271/10.11, 10.16, 271/10.08, 119, 121, 125, 274

[56] References Cited

U.S. PATENT DOCUMENTS

| | | | |
|---|---|---|---|
| 2,873,968 | 2/1959 | Grobman | 271/274 |
| 3,506,258 | 4/1970 | Lindquist | 271/119 |
| 5,192,141 | 3/1993 | Chung et al. | 271/119 |
| 5,545,882 | 8/1996 | Tanaka | 271/121 |
| 5,738,452 | 4/1998 | Uchida | 271/121 |
| 5,893,555 | 4/1999 | Kawada et al. | 271/121 |
| 5,927,705 | 7/1999 | Becker et al. | 271/114 |
| 5,938,191 | 8/1999 | Morrison et al. | 271/119 |

FOREIGN PATENT DOCUMENTS

| | | | |
|---|---|---|---|
| 359031230A | 2/1984 | Japan | 271/10.11 |
| 360157433A | 8/1985 | Japan | 271/10.11 |
| 403051231 | 3/1991 | Japan | 271/10.11 |

*Primary Examiner*—H. Grant Skaggs
*Attorney, Agent, or Firm*—John A. Brady

[57] ABSTRACT

A feed roll has a plurality of equiangularly spaced flat faces thereon for engaging a restraint roll to form a nip therebetween through which the lowermost envelope in a stack of envelopes is fed. A spring continuously urges the restraint roll into engagement with the feed roll. In one embodiment, curved portions connect the flat faces to each other. In another embodiment, the adjacent flat faces intersect each other to form comers on the periphery of the feed roll.

17 Claims, 7 Drawing Sheets

ENVELOPE FEEDER

CROSS-REFERENCE TO RELATED APPLICATION

Application of Friedbert R. Becker et al for "Envelope Feeder," Ser. No. 08/852,370, filed May 7, 1997.

FIELD OF THE INVENTION

This invention relates to an envelope feeder and, more particularly, to an envelope feeder having the size of an entrance to a nip increased when receiving a leading edge of an envelope to be advanced through the nip.

BACKGROUND OF THE INVENTION

It has previously been suggested in the aforesaid Becker et al application to feed envelopes from the bottom of a stack through a nip, which is formed between a feed roll and a restraint roll and receives a leading edge of each of the envelopes to be advanced. The restraint roll is rotated in the same direction as the feed roll so that the surfaces at the nip formed by the two rolls move in opposite linear directions. By forming the feed roll of a slightly higher coefficient of friction to paper than the restraint roll, the feed roll has a greater tangential drive than the restraint roll so that the lowermost envelope is advanced from the stack.

A torque limiting clutch has the biasing force of its spring selected so that the restraint roll rotates with the feed roll since the torque resulting from the tangential frictional force at the surface of the feed roll is greater than that produced by the restraint roll due to the torque limiting clutch. However, this biasing force is not so large as to cause rotation of the restraint roll with the feed roll when more than one of the envelopes enters the nip formed between the rolls so as to prevent more than one envelope from passing through the nip.

While the envelope feeder of the aforesaid Becker et al application has satisfactorily fed most envelopes, it has been found that envelopes of relatively long length (for example, greater than 12 inches) create a drag. It also has been found that envelopes with flaps of certain configurations tend to conform to an adjacent envelope so that two of these envelopes are advanced simultaneously from the bottom of the stack but cannot enter the nip because of their total thickness. Generally, envelopes vary widely in form, texture, and bundling throughout the world, resulting in various tendencies to feed unreliably.

SUMMARY OF THE INVENTION

The envelope feeder of the present invention is an improvement of the envelope feeder of the aforesaid Becker et al application. The envelope feeder of the present invention eliminates the need for any driving of the restraint roll by a unidirectional motor through a gear train. This elimination of the gear train reduces the cost of the envelope feeder.

Furthermore, the envelope feeder of the present invention provides a relatively large initial entry opening for the leading edge of the envelope being advanced thereto. As the feed roll of the envelope feeder of the present invention rotates after the leading edge of the envelope has been advanced into the nip between the feed roll and the restraint roll, the size of the entry opening decreases. This decrease in the size of the entry opening after the envelope has its leading edge advanced between the feed roll and the restraint roll also shifts the position of the nip along the surface of the restraint roll.

The envelope feeder of the present invention produces the initial large entry opening for the nip through forming the feed roll with a plurality of equiangularly spaced, substantially flat lower section or faces and resiliently biasing the restraint roll into engagement with the feed roll. Therefore, the substantially flat faces on the feed roll cause reciprocation of the position of the nip when the feed roll rotates from the position in which one of the substantially flat surfaces engages the restraint roll until the next of the substantially flat faces engages the restraint roll.

An object of this invention is to provide an improved envelope feeder.

Another object of this invention is to provide an envelope feeder having a relatively large entry opening at its nip when the leading edge of an envelope is being advanced into the nip.

A further object of this invention is to provide an envelope feeder in which the possibility of multiple feeding of envelopes is decreased.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
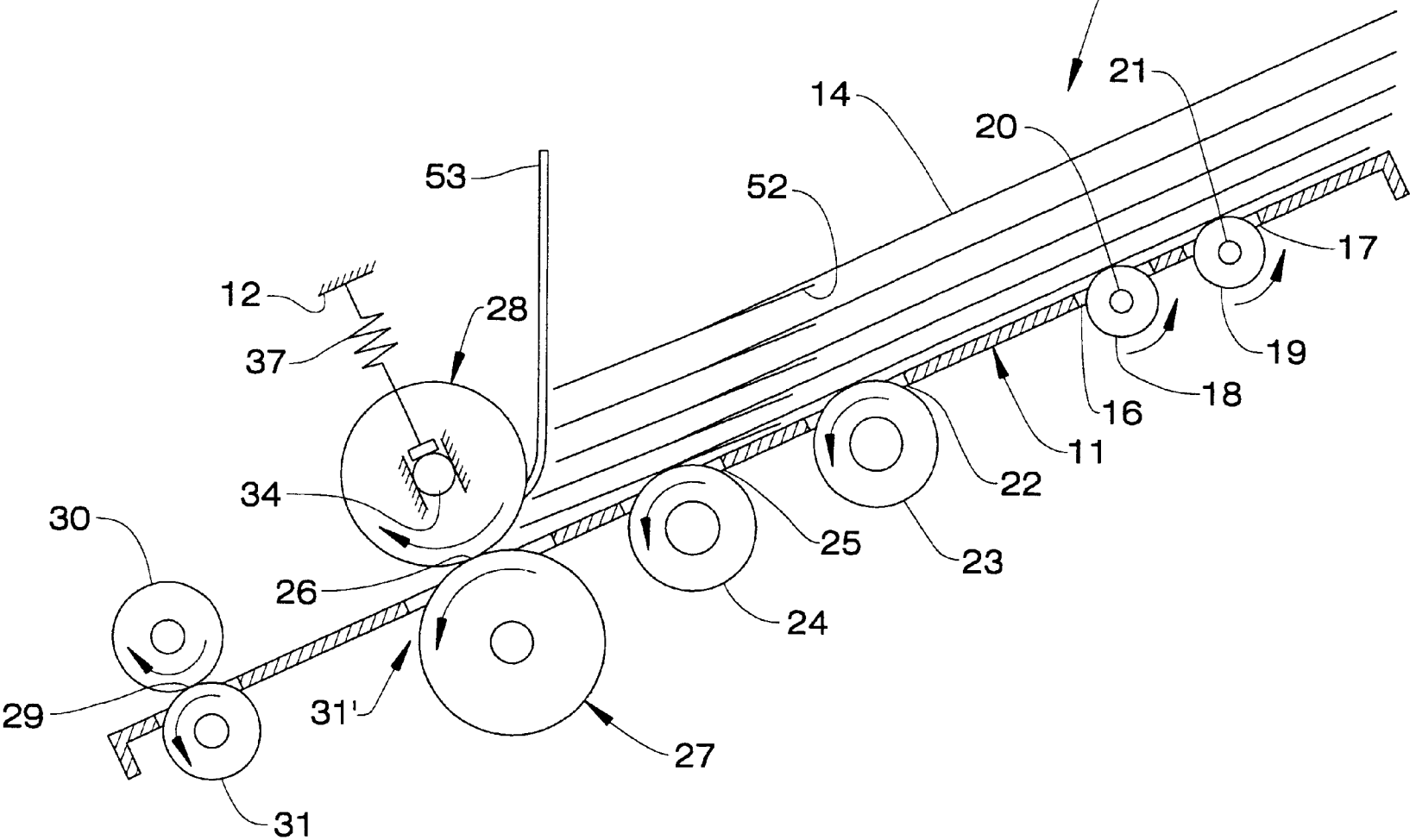
FIG. 1 is a fragmentary side sectional view, partly schematic, of a portion of an envelope feeder of the present invention.

Referring to the drawings and particularly FIG. 1, there is shown an envelope feeder 10 having a floor 11, which is attached to a frame 12 of the envelope feeder 10, for supporting a stack of envelopes 14. While the floor 11 is shown inclined, it should be understood that the floor 11 could be horizontal if desired.

As more particularly shown and described in the aforesaid Becker et al application, a left side wall 15 (see FIG. 2) and a right side wall 15', which are substantially parallel to each other, extend upwardly from opposite sides of the floor 11. The floor 11 has openings 16 (see FIG. 1) and 17 within which are disposed a plurality of support rolls 18 and a plurality of support rolls 19, respectively, as more particularly shown and described in the aforesaid Becker et al application. The support rolls 18 are mounted on tenons 20 (see FIG. 2) supported by the frame 12, and the support rolls 19 are mounted on tenons 21 supported by the frame 12.

The floor 11 (see FIG. 1) has openings 22 therein through which a first set of kick rolls 23 protrudes. A second set of kick rolls 24 extends through openings 25 in the floor 11.

As more particularly shown and described in the aforesaid Becker et al application, the kick rolls 23 and 24 advance the lowermost envelope 14 in the stack of the envelopes 14 into a nip 26, which is formed between a feed roll 27 and a restraint roll 28. The kick rolls 23 cease to advance the envelope 14 when the trailing edge of the envelope 14 moves past the kick rolls 23. The kick rolls 23 are stopped to prevent the next of the envelopes 14 from being advanced from the stack.

The kick rolls 24 remain activated to further advance the envelope 14 through the nip 26 and into a nip 29 between a plurality of drive rolls 30 and a plurality of back-up rolls 31, which are resiliently biased against the drive rolls 30, as more particularly shown and described in the aforesaid Becker et al application. Thus, the lowermost of the envelopes 14 is separated from the stack by the cooperation of the feed roll 27 and the restraint roll 28, which constitute a separator 31'.

Double feeding of envelopes 14 is reliably prevented by the action of restraint roll 28 at separator 31. Prior to this invention, entry of at least one envelope 14 into separator 31 was not entirely certain, thus resulting in no envelope 14 being fed. This occurred because a single envelope 14 was moved but did not enter nip 26 of separator 31. This also occurred because of movement of two envelopes 14 together which did not enter nip 26.

After the envelope 14 reaches the nip 29, the envelope 14 is advanced from the envelope feeder 10 by the drive rolls 30 to a process station of a printer (not shown). At the same time, the next lowermost envelope 14 in the stack will be advanced therefrom through the feed roll 27 and the restraint roll 28 cooperating with each other. Therefore, the lowermost envelope 14 is separated from the stack by the feed roll 27 and the restraint roll 28 after being fed thereto by the kick rolls 23 and 24.

It should be understood that the feed roll 27 is shown in FIG. 1 as having a continuous circular periphery for clarity purposes. However, as shown in FIG. 9, the feed roll 27 has a plurality of flat lower section or faces 32 equiangularly spaced around the periphery of the feed roll 27 with curved portions 33, which are a part of the original circle or configuration of the feed roll 27, therebetween.

The flat faces 32 are formed with a maximum depth of 0.3 mm when the feed roll 27 has a diameter of 24 mm. This is the preferred depth of the cut in the feed roll 27 for each of the flat faces 32. However, it should be understood that the flat faces 32 could be deeper or shallower, if desired. The flat faces 32 could have a maximum depth of at least 0.5 mm but the noise level produced in tests was not desirable.

Figure 9:
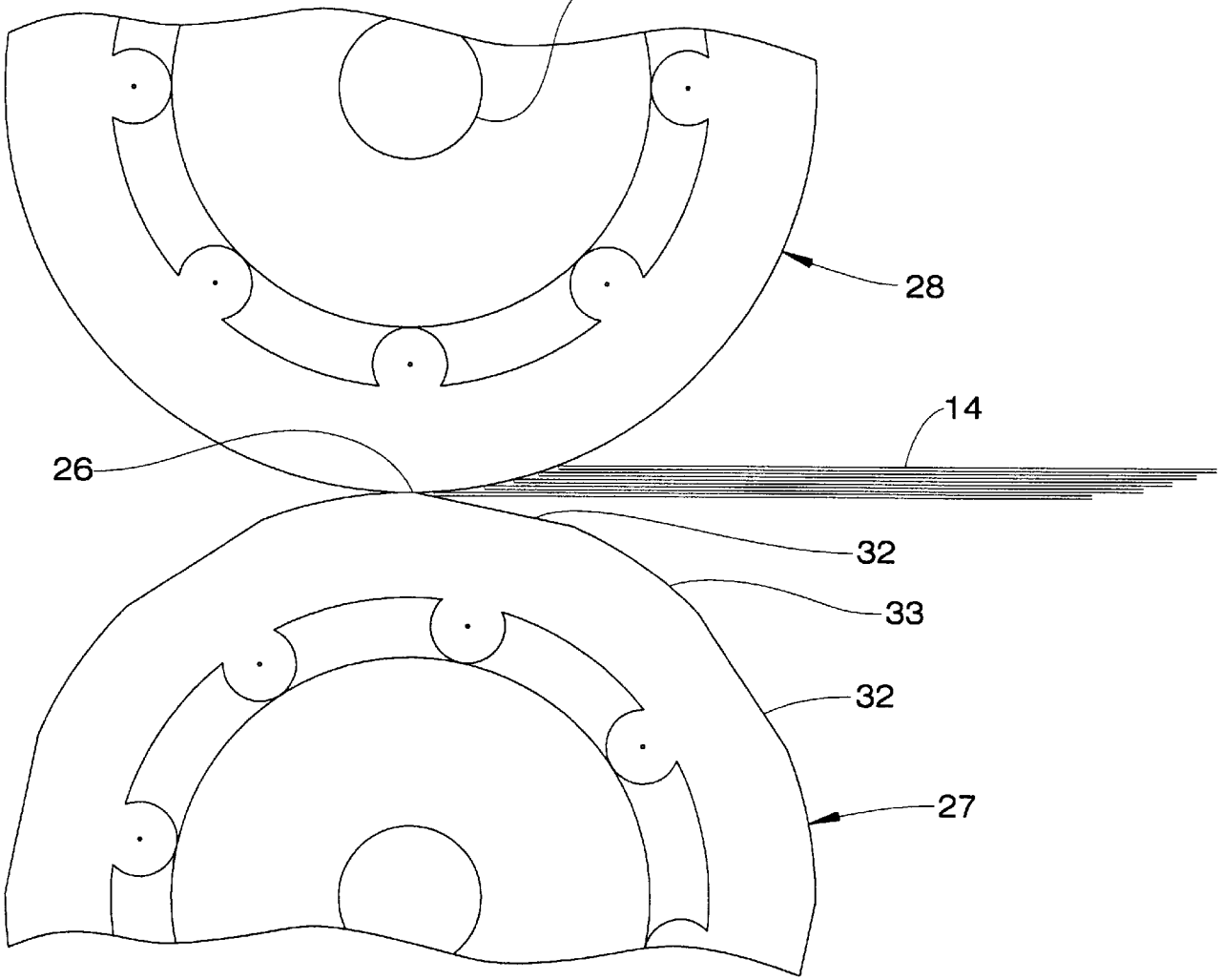
FIG. 9 is an enlarged schematic view, similar to FIG. 5, of portions of the feed roll and the restraint roll and showing more clearly the relation of the curved portion and the flat face on the circumference of the feed roll.

As shown in FIG. 9, each of the flat faces 32 provides a much larger entry opening for the envelopes 14, which are shown enlarged for clarity purposes. This enables easier entry of the lowermost of the envelopes 14 in the stack into the nip 26, which is formed between the circumference of the restraint roll 28 and the periphery of the feed roll 27. In FIG. 9, the nip 26 is formed where the flat face 32 is just starting to engage the restraint roll 28.

Figure 4:
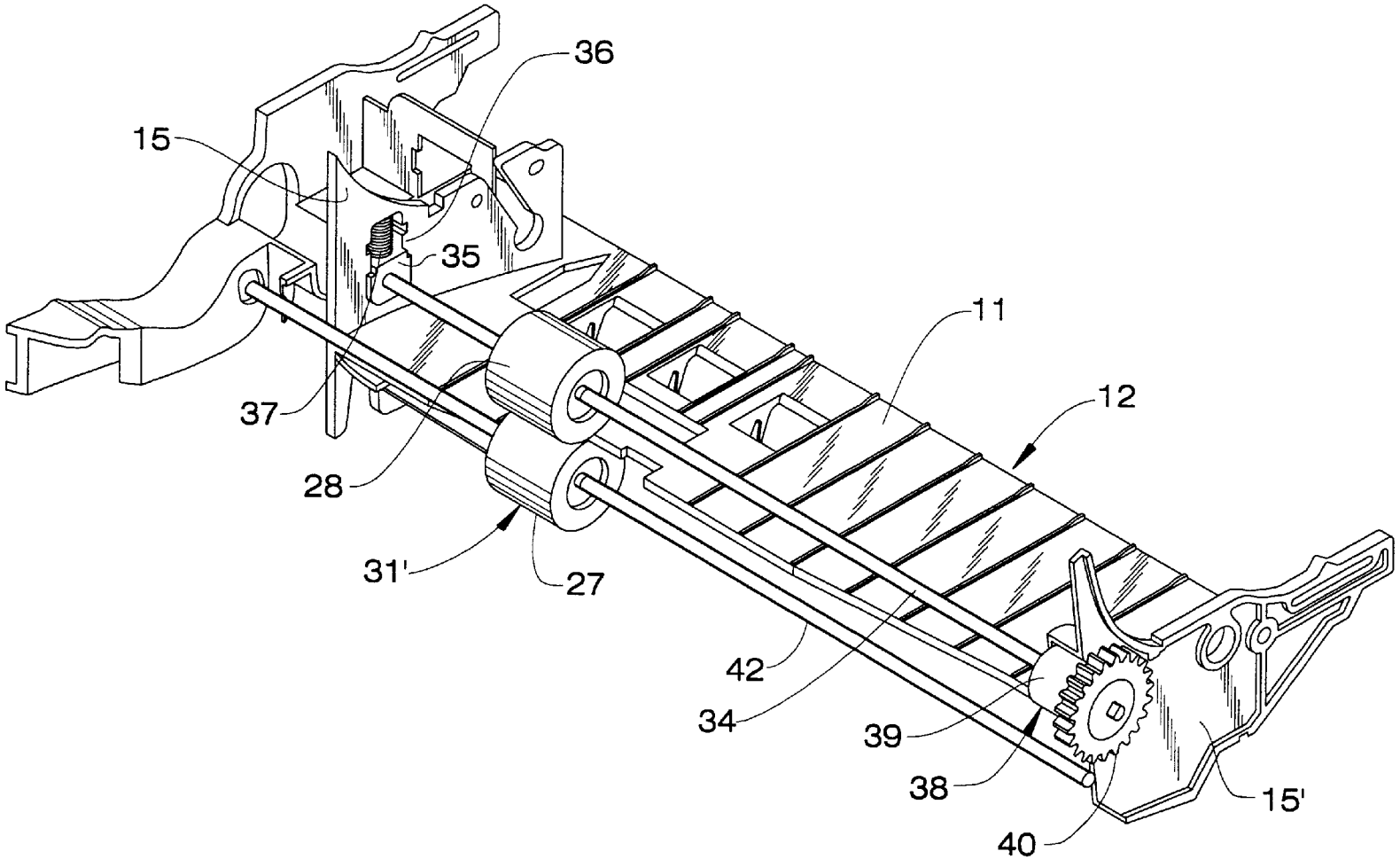
FIG. 4 is a perspective view of a portion of the envelope feeder showing the relation of feed and restraint rolls.

The restraint roll 28 (see FIG. 4) is fixed to a restraint roll shaft 34 for rotation therewith. One end of the restraint roll shaft 34 is rotatably supported in a bearing 35, which is disposed in an opening 36 in the left side wall 15.

A compression spring 37, which rests on top of the bearing 35 and is disposed in the opening 36, presses the restraint roll 28 against the feed roll 27. The other end of the spring 37 presses against the portion of the left side wall 15 defining the top of the opening 36. The bearing 35 is free to move vertically but is contained axially and horizontally in the left side wall 15.

The other end of the restraint roll shaft 34 extends through a torque limiting clutch 38 and a bearing (not shown) in the right side wall 15'. Two C-clips contain the shaft 34 axially to trap it in the right side wall 15'.

The torque limiting clutch 38 includes an inside hub having a flat on its inner bore mating with a flat on the right end of the restraint roll shaft 34, a wound coil spring, and an outer housing 39 made of plastic and having a gear 40, which is not utilized, molded on one end. The torque limiting clutch 38 is mounted on the right side wall 15' so that the gear 40 is exposed. The wound coil spring provides a predetermined slip torque in the drive direction.

The outer housing 39 of the torque limiting clutch 38 is mounted in an opening 47 (see FIG. 2) in the right side wall 15' and has a lug (not shown) mounted thereon. The lug engages a portion of the right side wall 15' defining the opening 47 to prevent rotation of the torque limiting clutch 38 (see FIG. 4) until the torque exceeds the torque limit of clutch 38. Accordingly, the restraint roll 28 normally is driven by the feed roll 27 when they are in contact. Torque roll 28 is not driven when two envelopes 14 are in separator 31 since the envelope 14 in contact with feed roll 27 slides against the other envelope 14.

The feed roll 27 is rotated counterclockwise (as viewed in FIG. 5) through its shaft 42 being rotated by a unidirectional motor (not shown) in the manner shown and described in the aforesaid Becker et al application. The feed roll 27 has a central plastic portion 48, which is mounted on the shaft 42, and an outer elastomeric portion 50. The outer elastomeric portion 50 is bonded to the central plastic portion 48.

Figure 6:
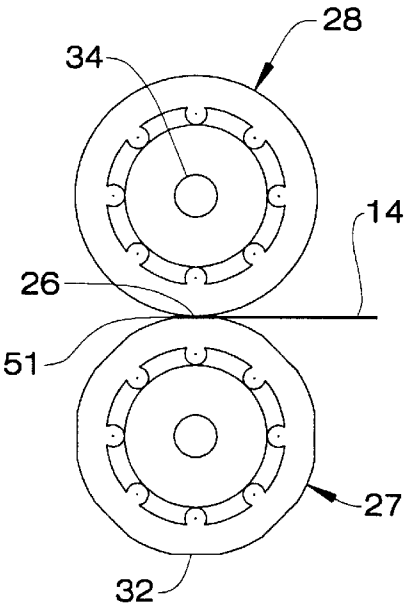
FIG. 6 is a schematic side elevational view, similar to FIG. 5, but with the feed roll having rotated so that the midpoint of the flat face of the feed roll is engaging the restraint roll.
Figure 5:
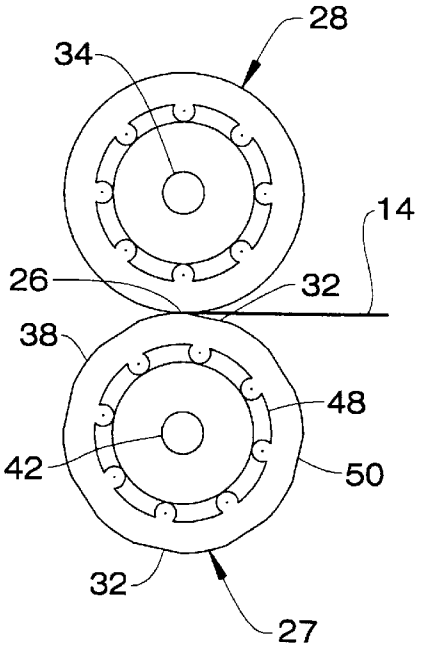
FIG. 5 is a schematic side elevational view of one embodiment of the feed roll of the envelope feeder cooperating with the restraint roll and showing the feed roll in the position to provide a maximum opening for entry of an envelope to be fed and having one of its flat faces ready to engage the restraint roll.

As the feed roll 27 rotates counterclockwise from the position of FIG. 5 to the position of FIG. 6, the flat face 32 of the feed roll 27 forms the nip 26 with the restraint roll 28. In the position of FIG. 6, the midpoint of the flat face 32 of the feed roll 27 is forming the nip 26 with the restraint roll 28, and the envelope 14 has its leading edge 51 advanced past the nip 26. The nip 26 also has moved to the left (that is, to the six o'clock position on the restraint roll 28 in comparison with the five thirty o'clock position in FIG. 5).

As the feed roll 27 rotates counterclockwise from the position of FIG. 5 to the position of FIG. 6, the spring 37 (see FIG. 1) continuously urges the restraint roll 28 against the feed roll 27 through the envelope 14. Thus, the shaft 34 of the restraint roll 28 is moved downwardly the maximum of 0.3 mm in FIG. 6 from its position in FIG. 5. Accordingly, the nip 26 is not only moved to the left in FIG. 6 from the position in FIG. 5 along the circumference of the restraint roll 28, but also moved downwardly.

Figure 7:
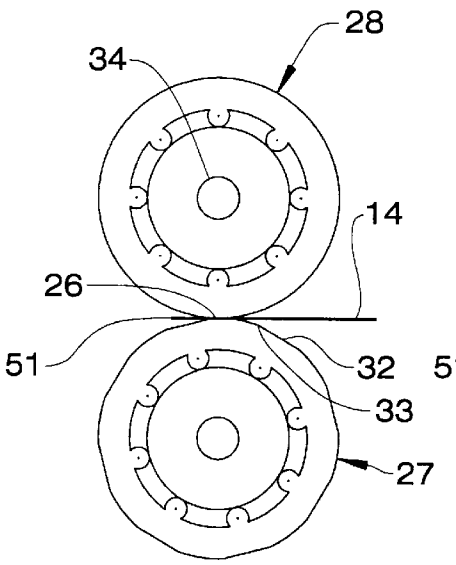
FIG. 7 is a schematic side elevational view, similar to FIGS. 5 and 6, in which the feed roll has rotated so that the flat face of FIG. 5 is just ceasing to engage the restraint roll.

Continued counterclockwise rotation of the feed roll 27 from the position of FIG. 6 causes the restraint roll 28 to be moved upwardly because of the inclination of the flat face 32. As shown in FIG. 7, the nip 26 has returned upwardly towards the position of FIG. 5.

After the flat face 32 on the feed roll 27 ceases to engage the restraint roll 28, the next of the curved portions 33 engages the circumference of the restraint roll 28. During this time, the envelope 14 has been advanced further through the nip 26 as shown in FIG. 7.

Figure 8:
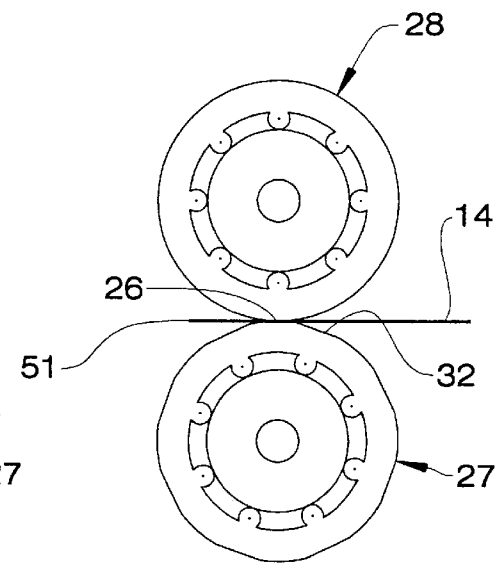
FIG. 8 is a schematic side elevational view, similar to FIGS. 5–7, in which the feed roll has rotated so that the next of its flat faces is ready to engage the restraint roll with the envelope having been advanced from the position of FIG. 5 through the positions of FIGS. 6 and 7.

Continued counterclockwise rotation of the feed roll 27 from the position of FIG. 7 to the position of FIG. 8 causes the next of the flat faces 32 to engage the restraint roll 28 whereby the nip 26 again starts to move to the left. Therefore, the maximum movement to the right of the nip 26 occurred in FIG. 7 when the flat face 32 engaged the restraint roll 28. Accordingly, the nip 26 reciprocates between the two positions.

Furthermore, because of the restraint roll 28 being biased continuously by the spring 37 (see FIG. 1), the spring 37 moves in accordance with the configuration of the feed roll 27 so that the nip 26 also moves vertically in addition to its reciprocation. Of course, the maximum motion perpendicular to the feeding of the envelope 14 in each direction is only 0.3 mm (the maximum depth of the flat face 32 with respect to the circumference of the feed roll 27).

Each of the envelopes 14 includes a flap 52 (see FIG. 1). While the flap 52 is shown on the leading edge of the envelope 14, it should be understood that the envelope 14 could be positioned so that the flap 52 is on the side when the envelope 14 is fed. It also should be understood that the maximum size of the entry opening for the leading edge 51 (see FIG. 7) of the lowermost envelope 14 is when one of the flat faces 32 on the feed roll 27 is just starting to engage the restraint roll 28 as shown in FIGS. 5 and 8.

Figure 2:
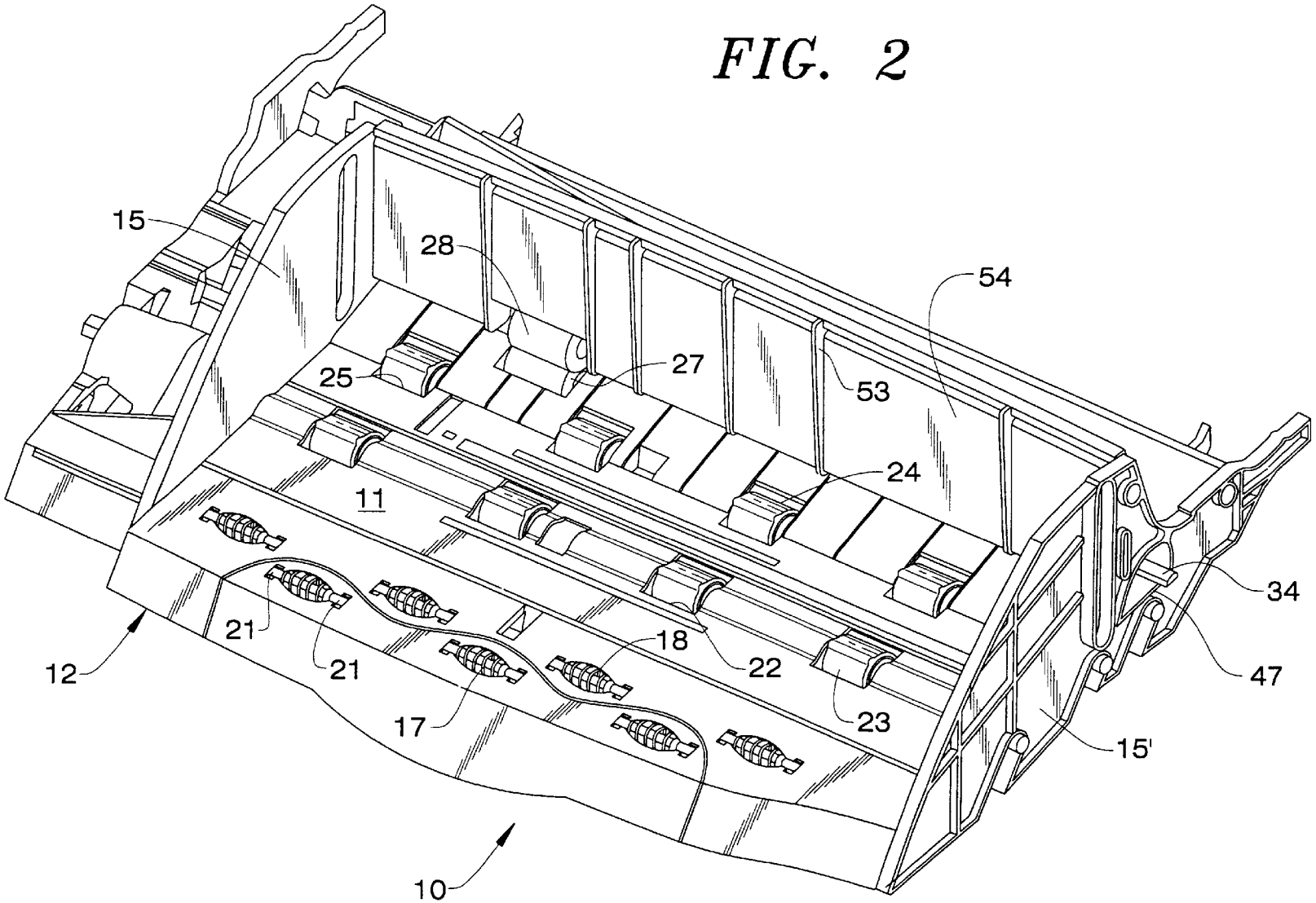
FIG. 2 is a perspective view of the envelope feeder looking rearward from the front.
Figure 3:
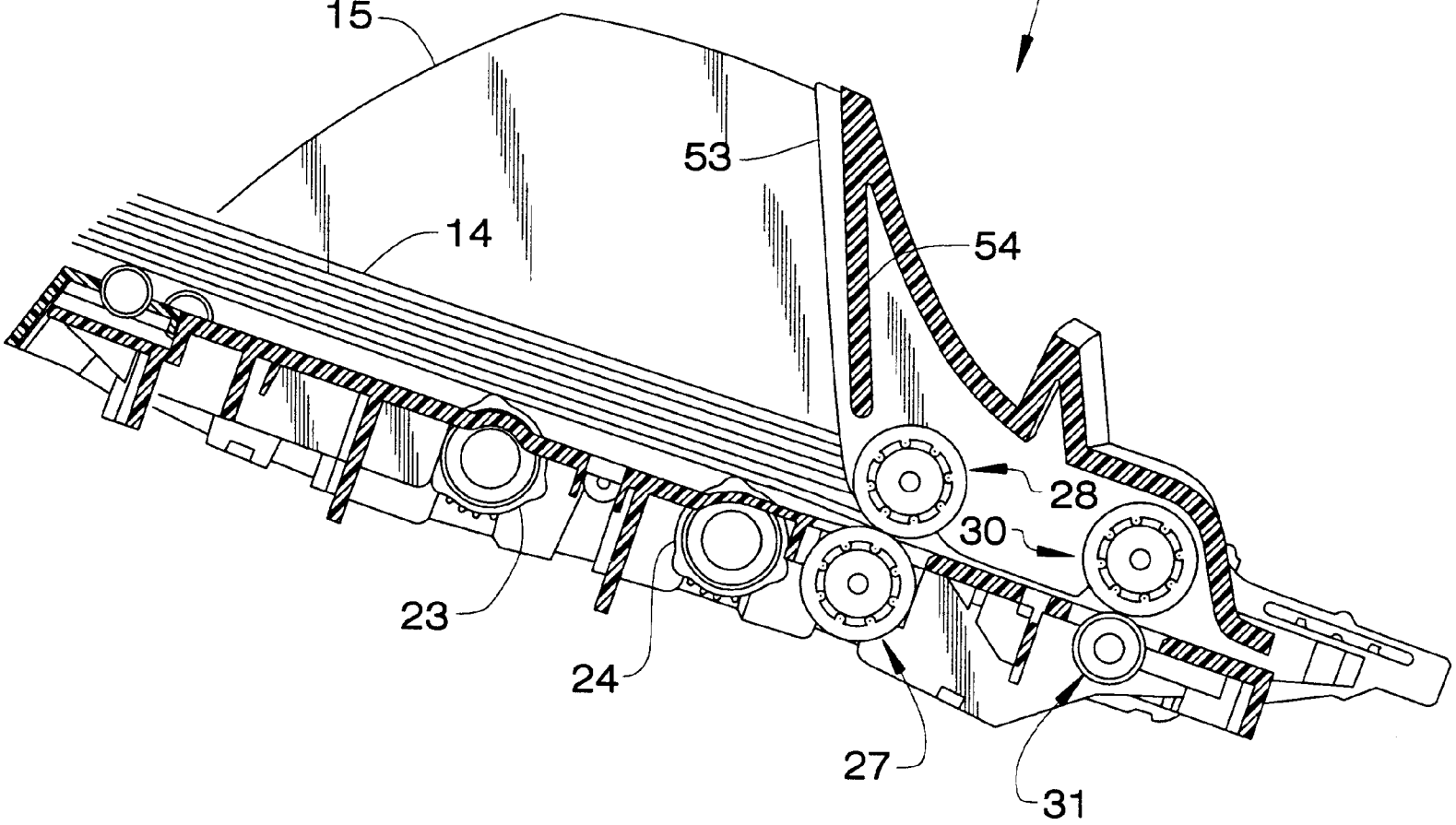
FIG. 3 is a fragmentary side elevational view, partly in section, of a portion of the envelope feeder and taken from the opposite side to FIG. 1.

As shown in FIG. 3, each of the envelopes 14 engages either the circumference of the restraint roll 28 or a plurality of ribs 53. As shown in FIG. 2, the ribs 53 are supported on an inclined wall 54, which extends between the side walls 15 and 15'.

Referring to FIGS. 10–14, there is shown a polygonal shaped feed roll 55 for cooperation with the restraint roll 28. The feed roll 55 has six flat faces 56 formed thereon with each having a maximum depth of 1.6 mm for a diameter of 24 mm in the same manner as the feed roll 27 (see FIG. 5).

Figure 10:
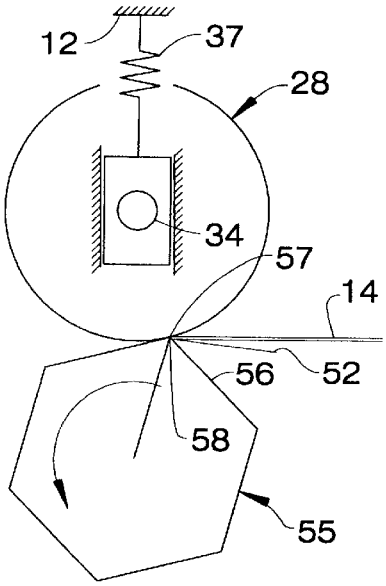
FIG. 10 is a schematic side elevational view of another embodiment of the feed roll cooperating with the restraint roll in which the feed roll has its periphery formed solely of flat faces and showing a corner at the intersection of two adjacent flat faces of the feed roll engaging the restraint roll to provide the initial maximum size of the entry opening to a nip formed between the feed roll and the restraint roll.

As shown in FIG. 10, a comer 57, which is formed at the intersection of two of the adjacent flat faces 56, is engaged with the restraint roll 28 to form a nip 58 therebetween. Thus, the maximum amount of the entry opening to the nip 58 is shown in FIG. 10.

Figure 11:
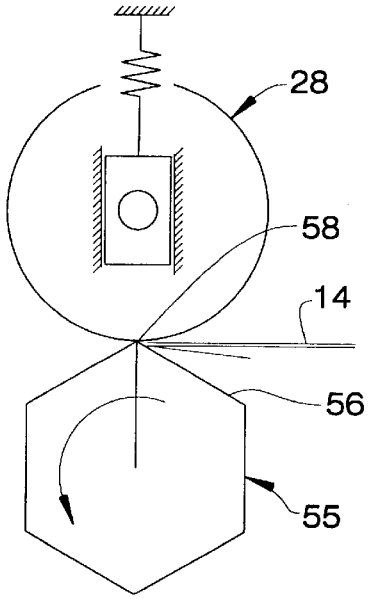
FIG. 11 is a schematic side elevational view, similar to FIG. 10, but showing the feed roll having rotated so that the comer engages the restraint roll at the six o'clock position on the restraint roll.
Figure 12:
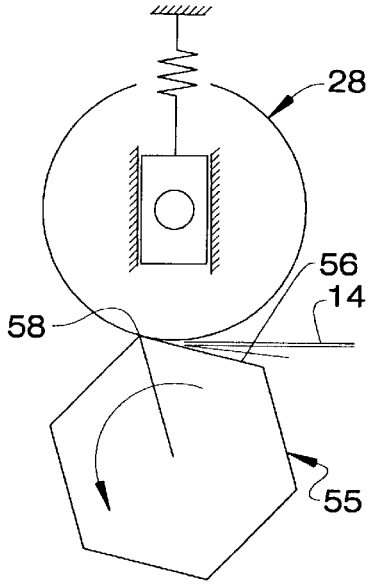
FIG. 12 is a schematic side elevational view, similar to FIGS. 10 and 11, in which the feed roll has rotated so that a portion of the flat face is engaging the restraint roll.

As the flat face 56 begins to engage the restraint roll 28 as shown in FIG. 11 due to counterclockwise rotation of the feed roll 55, the nip 58 moves from the five thirty o'clock position on the restraint roll 28 to the six o'clock position on the restraint roll 28. As the feed roll 55 continues to rotate counterclockwise, the flat face 56 advances the nip 58 to the six thirty o'clock position on the restraint roll 28 as shown in FIG. 12. This is the maximum movement of the nip 58 to the left.

Figure 13:
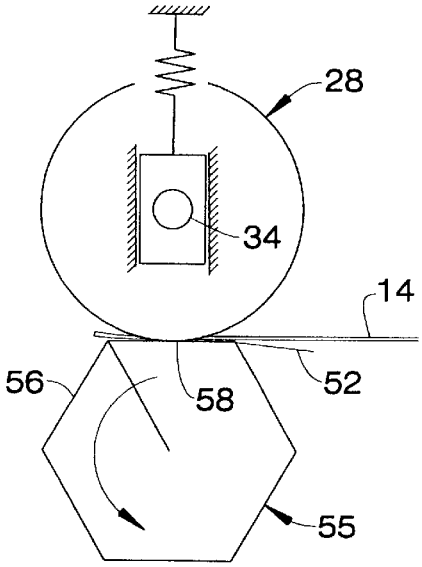
FIG. 13 is a schematic side elevational view, similar to FIGS. 10–12, in which the feed roll has rotated so that the flat face of FIG. 12 has its midpoint at the six o'clock position of the restraint roll whereby the envelope has been advanced.
Figure 14:
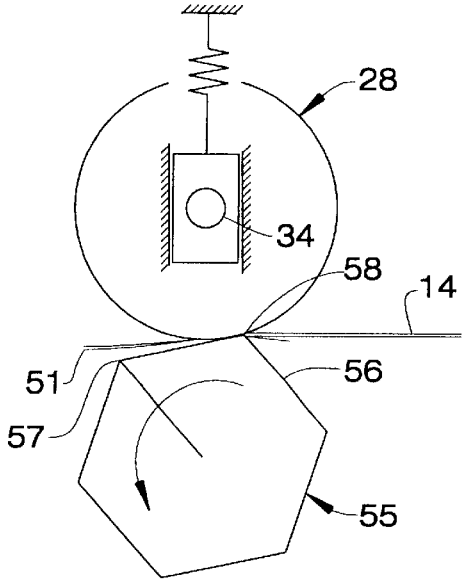
FIG. 14 is a schematic side elevational view, similar to FIG. 10, in which the feed roll has rotated so that the next comer is engaging the restraint roll at the same position as in FIG. 10 with the envelope having its leading edge past the nip formed between the feed roll and the restraint roll.

Continued counterclockwise rotation of the feed roll 55 from the position of FIG. 12 to the position of FIG. 13 causes the nip 58 to begin to return to its initial position. The nip 58 returns to its initial position when the feed roll 55 has rotated counterclockwise to dispose another of the corners 57 of the feed roll 55 in engagement with the restraint roll 28 as shown in FIG.14.

When the feed roll 55 is in the position of FIG. 13, the shaft 34 of the restraint roll 28 will have moved downwardly perpendicular to the feeding path of the envelope 14 the maximum distance of 1.6 mm. This is because the position of FIG. 13 has the midpoint of the flat face 56 engaging the restraint roll 28 at the six o'clock position to form the nip 58.

While the feed roll 27 (see FIG. 5) has been shown with eight of the flat faces 32 and the feed roll 55 (see FIG. 10) has been shown with six of the flat faces 56, it should be understood that any number of flat faces may be employed. It also is not necessary that there be an even number of flat faces.

An advantage of this invention is that it significantly decreases the cost of an envelope feeder since it eliminates the need of a gear train for driving a restraint roll. A torque restraint clutch for the restraint roll is not believed essential to practicing this invention. However, the torque restraint clutch permits a random repositioning of the restraint roll, thereby distributing wear on the restraint roll for which some mechanism to do so is important. A major advantage of this invention is that it eliminates feeding failures of an envelope feeder because of more than one envelope binding together since the larger nip permits them to enter the nip and then be separated so that a single envelope is fed very reliably with each feed operation. Similarly, single envelopes of a wide variety of materials and textures enter the nip of this invention so that a single envelope is fed very reliably.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An envelope feeder for feeding an envelope from a stack of envelopes including:

support means for supporting a stack of envelopes;

advancing means for advancing an envelope from the stack of envelopes;

a nip for receiving each advanced envelope during its removal from the stack of envelopes by said advancing means, said nip being formed by a restraint roll and a driven feed roll, said restraint roll being movable to said feed roll and being urged to move to said feed roll; and at least one lower section on the periphery of said feed roll forming a nip between said restraint roll and said lower section in which said restraint roll follows the periphery of said lower section to vary the size of the entry opening to said nip from a maximum when it initially receives an advanced envelope to a minimum as the advanced envelope is advanced by said advancing means.

2. The envelope feeder according to claim 1 in which said feed roll has a plurality of said lower sections equiangularly spaced on its periphery.

3. The envelope feeder according to claim 2 in which said feed roll includes at least six of said lower sections.

4. The envelope feeder according to claim 2 in which said lower section of said feed roll shift the position of engagement with said restraint roll so that said nip reciprocates during advancement of the advanced envelope through said nip.

5. The envelope feeder according to claim 2 in which each of said lower sections of said feed roll intersects adjacent of said lower sections.

6. The envelope feeder according to claim 2 in which said feed roll has curved portions on its circumference between each adjacent pair of said lower sections.

7. An envelope feeder for feeding a lowermost envelope from a stack of envelopes including:

support means for supporting a stack of envelopes;

advancing means for advancing the lowermost envelope from the stack of envelopes;

a nip for receiving the lowermost envelope during its removal from the stack of envelopes, said nip being formed by a restraint roll and a driven feed roll, said restraint roll being movable to said feed roll and being urged to move to said feed roll; and at least one lower section on the periphery of said feed roll forming a nip between said restraint roll and said lower section in which said restraint roll follows the periphery of said lower section to vary the size of the entry opening to said nip from a maximum when it initially receives the lowermost envelope to a minimum as the lowermost envelope is advanced by said advancing means.

8. The envelope feeder according to claim 7 in which said feed roll has a plurality of said lower sections equiangularly spaced on its periphery.

9. The envelope feeder according to claim 8 in which said feed roll includes at least six of said lower sections.

10. The envelope feeder according to claim 8 in which said lower sections of said feed roll shift the position of engagement with said restraint roll so that said nip reciprocates during advancement of the lowermost envelope through said nip.

11. The envelope feeder according to claim 8 in which each of said lower sections of said feed roll intersects adjacent of said lower sections.

12. The envelope feeder according to claim 8 in which said feed roll has curved portions on its circumference between each adjacent pair of said lower sections.

13. A media feeder for feeding media from a stack of media comprising:

a support surface for holding a stack of media on said support surface;

media advancing means for advancing media off of said stack of media;

a restraint roll, said restraint roll being mounted for movement in a first direction and being urged to move in said first direction; and a driven feed roll, said feed roll having at least one generally flat, lower section on the periphery of said feed roll, wherein said restraint roll and said feed roll form a nip for receiving media advanced by said media advancing means and said first direction is toward said nip so that said restraint roll follows said generally flat lower section to form a moving nip having an entry opening which is largest when said generally flat, lower section is first opposite said restraint roll.

14. The media feeder according to claim 1 in which said feed roll has a plurality of said generally flat, lower sections on its periphery.

15. The media feed according to claim 14 in which said feed roll includes at least six of said generally flat, lower sections.

16. The media feeder according to claim 14 in which each of said generally flat, lower sections of said feed roll intersects adjacent of said flat faces.

17. The media feeder according to claim 14 in which said feed roll has curved portions on its circumference between each adjacent pair of said generally flat, lower sections.

* * * * *